US006223709B1

(12) United States Patent
Takahashi

(10) Patent No.: US 6,223,709 B1
(45) Date of Patent: May 1, 2001

(54) FOUR CYCLE ENGINE

(75) Inventor: Katsunori Takahashi, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/395,373

(22) Filed: Sep. 14, 1999

(30) Foreign Application Priority Data

Sep. 14, 1998 (JP) ..... 10-279426

(51) Int. Cl.[7] ..... F01N 3/24
(52) U.S. Cl. ..... 123/193.5
(58) Field of Search ..... 123/193.5, 193.3, 123/90.27, 90.16

(56) References Cited

U.S. PATENT DOCUMENTS

| | | | |
|---|---|---|---|
| 4,417,442 | 11/1983 | Ikenoya et al. . | |
| 4,450,684 | 5/1984 | Otani et al. . | |
| 4,476,676 | 10/1984 | Ikenoya et al. . | |
| 4,499,724 | 2/1985 | Ikenoya et al. . | |
| 4,727,717 | 3/1988 | Ikenoya et al. . | |
| 5,657,628 | 8/1997 | Takeuchi . | |
| 5,704,315 * | 1/1998 | Tsuchida et al. | 123/90.27 |

FOREIGN PATENT DOCUMENTS

| | | |
|---|---|---|
| 55-146224 | 11/1980 | (JP) . |
| 57-13213 | 1/1982 | (JP) . |
| 9-324624 | 12/1997 | (JP) . |

* cited by examiner

*Primary Examiner*—Marguerite McMahon
(74) *Attorney, Agent, or Firm*—Birch, Stewart, Kolasch & Birch, LLP

(57) ABSTRACT

A cam holder includes a second air passage. A lower knock pin is positioned in the second air passage and service to position the cam holder on a cylinder head and to connect the second air passage to a first air passage formed in the cylinder head. The second air passage is bent and can be formed by machining from two directions into in the cam holder. The lower knock pin is press-fitted in a first groove around a perimeter of a lower opening of the second air passage. A second groove can be formed around the first groove to accommodate an o-ring. An upper knock pin is press-fitted in a third groove around a perimeter of an upper opening of the second air passage. The upper knock pin serves to position the cam holder on a cylinder head cover and to connect the second air passage to a third air passage formed in the cylinder head cover. The first, second and third air passages form a secondary air supply passage to supply cleaned air to an exhaust port in the cylinder head and thus improve the emissions of the exhaust system.

18 Claims, 4 Drawing Sheets

FOUR CYCLE ENGINE

BACKGROUND OF THE INVENTION

1. Field of the Invention

The present invention relates to a four-cycle engine including a secondary air supply passage for introducing secondary air into an exhaust port.

2. Description of the Background Art

Japanese Patent Laid-open No. Hei 9-324624 shows a secondary air supply passage for introducing secondary air into an exhaust port of a cylinder head. The secondary air supply passage connects a reed valve chamber provided in the cylinder head cover to the exhaust port provided in the cylinder head. The connecting section between the cylinder head and cylinder head cover is sealed with a knock pin.

It is known that a positioning knock pin is used to position a cam holder in the cylinder head. Further, there are some structures that use a part of a bolt hole for tightening the cam holder and provide a knock pin at another position apart from the bolt hole.

Incidentally, in the case where the bolt hole is used as a knock pin for positioning the cam holder, it is impossible to bring the bolt close to the camshaft, as the diameter of the knock pin becomes larger. Moreover, making the positioning knock pin separate from the bolt hole will necessitate a dedicated boss, thereby increasing the weight of the engine.

SUMMARY OF THE INVENTION

It is an object of the present invention to solve one or more of the drawbacks associated with the background art.

It is a further object of the present invention to provide a simplified cylinder head, cam holder, and cylinder head cover.

It is a further object of the present invention to reduce the number of knock pins needed by having the knock pins serve a dual function of positioning and sealing the secondary air supply passages.

It is a further object of the present invention to provide an arrangement whereby the cylinder head cover and cam holder can be more compact and more easily manufactured.

These and other objects of the present invention are provided by an engine comprising: a cylinder head body having a cam holder mating surface; a cam holder attached to said cylinder head body and abutting said cam holder mating surface; a cam shaft interposed between said cylinder head body and said cam holder; a first passage formed in said cylinder head body; and a second passage formed in said cam holder, communicating with said first passage to pass secondary air into said cylinder head body.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
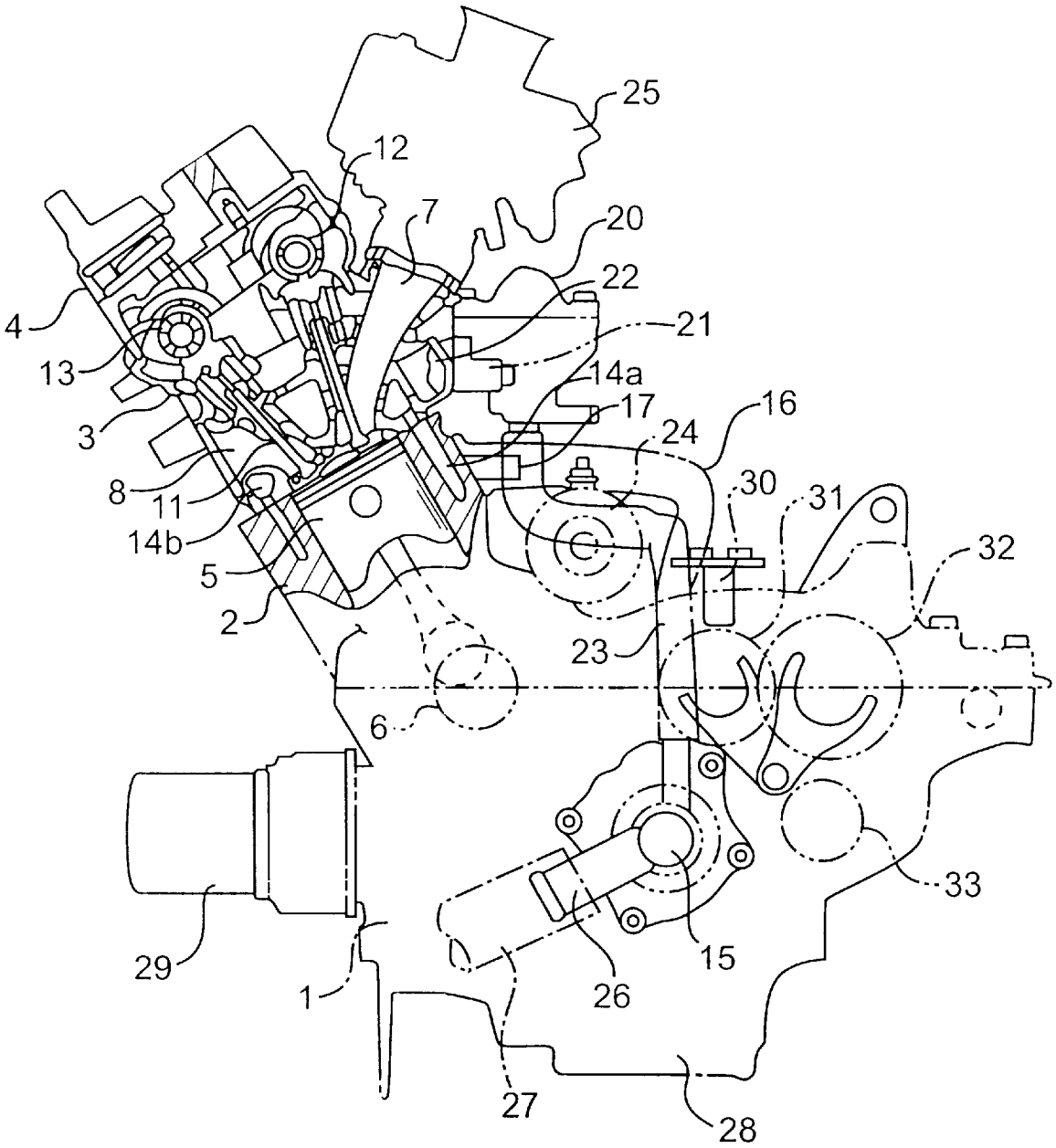
FIG. 1 is a partial cross sectional view of an engine with a secondary air supply passage, in accordance with the present invention.

An explanation of an engine including the secondary air supply passage, in accordance with the present invention, will be given with reference to FIG. 1. The engine is a DOHC (double overhead cam) type, water cooled four cycle engine. The engine is provided with crankcase 1, cylinder 2, cylinder head 3, and cylinder head cover 4.

A piston 5 slides freely inside cylinder 2. The piston 5 is connected to a crankshaft 6 (in the center of the drawing) inside a crankcase 1. A combustion chamber 9 is formed between the piston 5, the cylinder 2, and cylinder head 3.

An air supply port 7 and an exhaust gas port 8 are provided in the cylinder head 3 and connect with the combustion chamber 9. The air supply port 7 and the exhaust gas port 8 are opened and closed by an air supply valve 10 and an exhaust gas valve 11, respectively. The air supply valve 10 and the exhaust gas valve 11 are operated by cams on camshafts 12, 13, which revolve simultaneously with crankshaft 6.

The engine includes water jackets 14*a*, 14*b*, a water pump 15, a water hose 16, a thermostat 20, a cooling water outlet part 22, and a bypass hose 23. The engine also includes a starter motor 24, a carburetor 25, an inlet pipe 26 supplying chilled water from the radiator via a water hose 27, an oil pan 28, an oil filter 29, a speed sensor 30 for the transmission provided on a main shaft 31, a counter shaft 32 and a shift drum 33.

Figure 2:
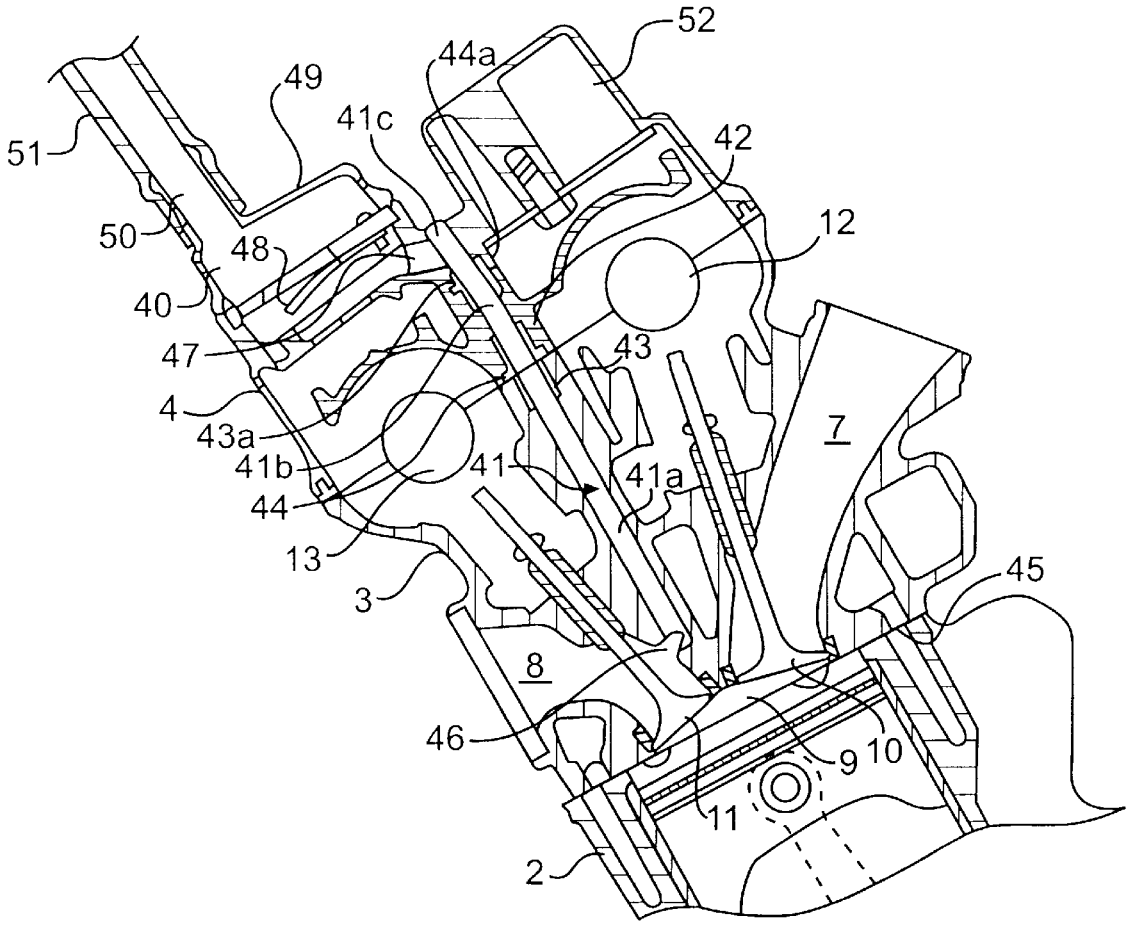
FIG. 2 is a cross sectional view illustrating the secondary air supply passage of FIG. 1.

Next, a description will be given for a secondary air supply passage 41. As illustrated in FIG. 2, the secondary air supply passage 41 connects a reed valve chamber 40 provided on an upper surface of the cylinder head cover 4 to the exhaust port 8. The secondary air supply passage 41 includes of a first passage 41*a* in the cylinder head 3, a second passage 41*b* in the cam holder 42, and a third passage 41*c* in the cylinder head cover 4. A connection between the first passage 41*a* and second passage 41*b* is sealed with a lower knock pin 43 and an o-ring 44. Likewise, a connection between the second passage 41*b* and the third passage 41*c* is sealed by an upper knock pin 43*a* and an upper o-ring 44*a*. The secondary air supply passage 41 is formed generally perpendicular to a gasket surface of a head gasket 45 that seals between the cylinder 2 and cylinder head 3.

The first passage 41*a* communicates with the exhaust port 8 through a horn-shaped hole 46 integrally formed in the exhaust port 8. The horn-shaped hole 46 is formed in the exhaust port 8 by a projection on a core for the exhaust port 8, when the cylinder head 3 is cast. Later, first passage 41*a* is connected to the exhaust port 8 by being notched when the first passage 41*a* is machined after casting.

The second passage 41*b* is bent in the middle. The bend can be easily formed by machining from both sides of the cam holder 42 in the vertical direction at different angles. The second passage 41*c* is formed in a thick part at the center section of the cylinder head cover 4 and communicates with the reed valve chamber 40 through a passageway 47 formed in a slanting direction.

Figure 3:
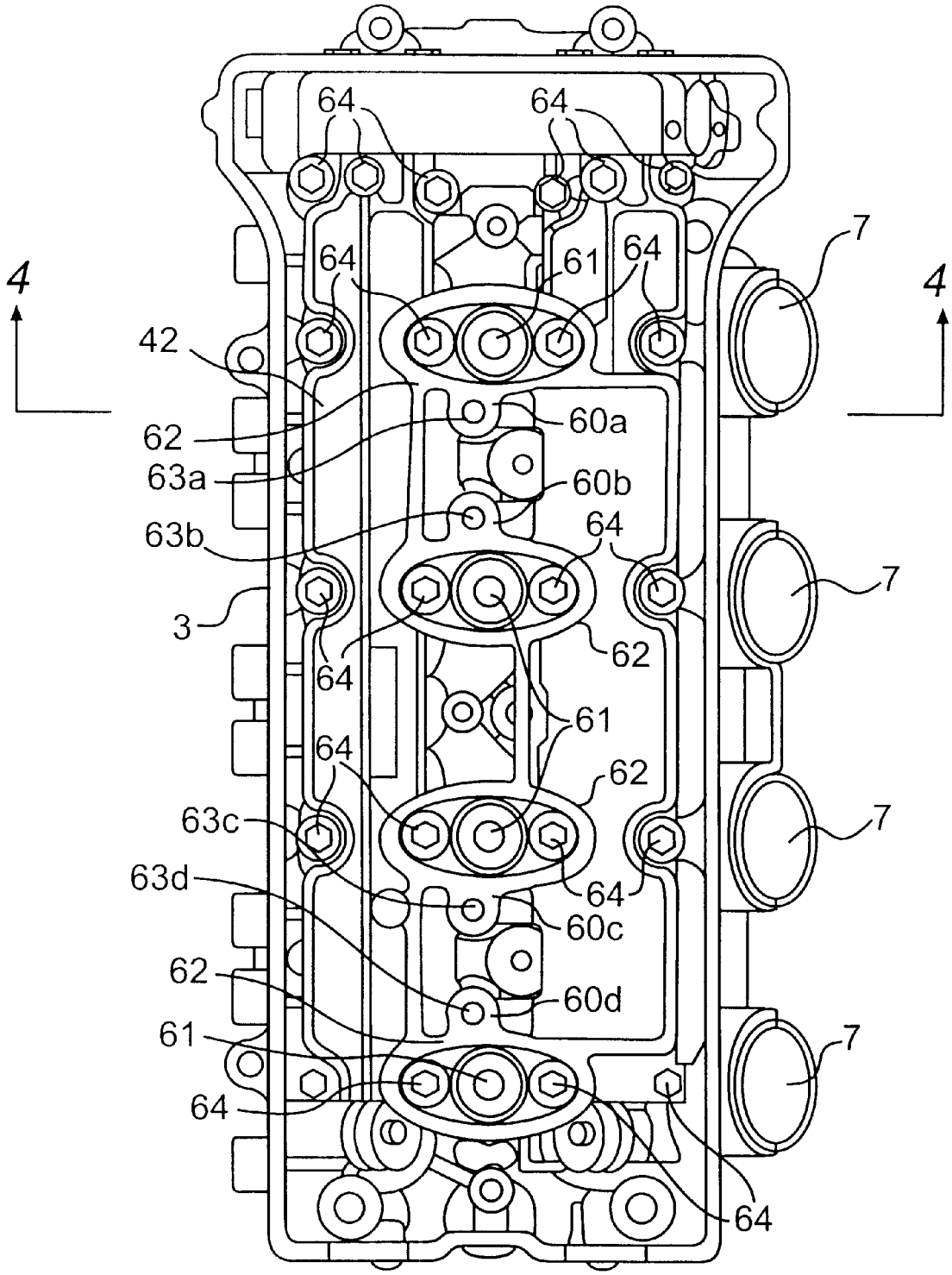
FIG. 3 is a top view of cylinder head and cam holder with the cylinder head cover removed.

A reed valve 48 is provided in the reed valve chamber 40 and closed with a cover 49. A joint pipe 50 is integrally formed on the cover 49. Clean secondary air is provided from a filter, not shown in the drawings, through a hose 51 connected to the joint pipe 50 into the reed valve chamber 40. The reed valve 48 feeds the secondary air to the exhaust port 8 via the secondary air supply passage 41. The reed valve 48 interlocks using exhaust vibrations within the exhaust port 8. In FIG. 3, reference numeral 52 indicates a breather chamber.

FIG. 3 illustrates the cylinder head 3 and the cam holder 42 with the cylinder head cover 4 removed. Knock pin bosses 60*a*, 60*b*, 60*c*, 60*d* are provided on the cylinder head 3 corresponding to each cylinder. Each knock pin boss 60*a*, 60*b*, 60*c*, 60*d* is provided integrally with a rib 62 surrounding a plug hole. Upper holes 63*a*, 63*b*, 63*c*, 63*d* are provided on respective ones of the knock pin bosses 60*a*, 60*b*, 60*c*, 60*d* for attaching upper knock pins. A respective upper knock pin 43*a*, 43*b*, 43*c*, 43*d* is attached in each upper hole 63*a*, 63*b*, 63*c*, 63*d* connecting the cylinder head cover 4 to the cam holder 42. The diameters of the upper holes 63*a*, 63*b*, 63*c*, 63*d* are set in such a way that the knock pin bosses 60*a*, 60*b* corresponding to the outside cylinders will be slightly looser than the knock pin bosses 60*c*, 60*d* corresponding to the inside cylinders.

The upper holes 63*a*, 63*b*, 63*c*, 63*d* respectively form part of the third passage 41*c* so that the degree of looseness is set to maintain the sealing capability required for sealing the secondary air supply passage 41. Therefore, it is possible to make all the upper holes 63*a*, 63*b*, 63*c*, 63*d* loose if the degree of looseness is within an acceptable range.

In FIG. 3, the cam holder 42 is fastened to the cylinder head 3 by bolts 64. In attaching the cam holder 42 to the cylinder head 3, the air intake camshaft 12 and the exhaust camshaft 13 are positioned in parallel in a transverse direction between the cylinder head 3, and sandwiched between the cylinder head 3 and the cam holder 42.

Figure 4:
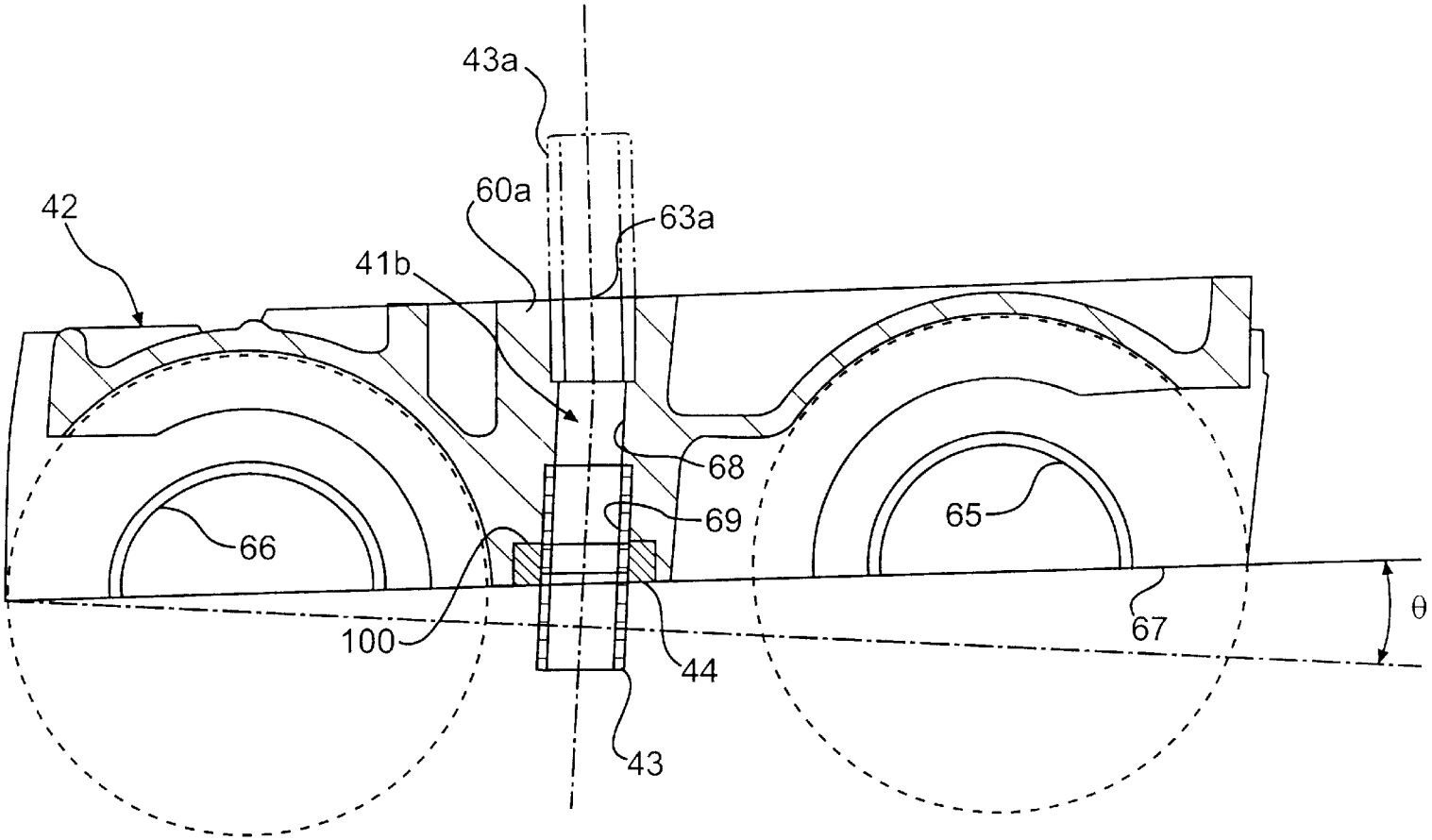
FIG. 4 is a cross sectional view taken across line 4—4 in FIG. 3.

FIG. 4 is a cross sectional view taken across line 4—4 in FIG. 3. FIG. 4 illustrates the knock pin boss 60*a* and the upper hole 63*a* in the cam holder 42. The structure of the knock pin boss 60*a* and the upper hole 63*a* is the same as that of the other knock pin bosses 60*b*, 60*c*, 60*d* and the other upper holes 63*b*, 63*c*, 63*d*. As shown in FIG. 4, a bearing section 65 for the air intake camshaft 12 and a bearing section 66 for the exhaust camshaft 13 are provided to the front and rear sides of the second passage 41*b*. The knock pin boss 60*a* is formed between the bearing sections 65, 66. A junction surface 67 is provided between the cylinder head 3 and the cam holder 42. The junction surface is inclined by an angle θ to the sealing surface of the head gasket 45.

The upper hole 63*a* and a lower hole 68 are formed in the knock pin boss 60*a*. The upper hole 63*a* extends in a direction which is perpendicular to the junction surface 67. The lower hole 68 extends in a direction which is inclined to the junction surface 67 and perpendicular to the sealing surface of the head gasket 45. The upper hole 63*a* and the lower hole 68 communicate within the thick section of the knock pin boss 60*a* that is bent, and thereby constitute the second passage 41*b* of the secondary air supply passage 41.

An indented section 69, having a larger diameter than the lower hole 68, is formed around the lower hole 68, facing toward the cylinder head 3. The indented section 69 has a back wall 100 which is formed substantially parallel to the junction surface 67. The lower o-ring 44 is press fitted into the indented section 69 adjacent the lower knock pin 43. The lower knock pin 43 and the lower o-ring 44 seal the junction surface 67 between the first passage 41*a* in the cylinder head 3 and the second passage 41*b* in the cam holder 42. The lower knock pin 43 also serves as a positioning guide to seat the cam holder 42 on the cylinder head 3.

Similarly, the upper knock pin 43*a* and an upper o-ring 44*a* (see FIG. 3) seals the junction surface between the second passage 41*b* in the cam holder 42 and the third passage 41*c* in the cylinder head cover 4. The upper knock pin 43*a* also serves as a positioning guide to seat the cylinder head cover 4 to the cam holder 42. Therefore, the upper and lower knock pins 43*a*, 43 have a dual function of sealing and positioning the secondary air supply passage 41.

Now, several of the advantages of the present invention will be described. As illustrated in FIG. 4, the second passage 41*b* is formed in the cam holder 42 and forms a part of the secondary air supply passage 41. Therefore, it is not necessary to provide an extended length boss to pass secondary air from the cylinder head 3 to the cylinder head cover 4. This arrangement simplifies the structure of the cylinder head cover 4.

The upper and lower knock pins 43*a*, 43, located in the second passage 41*b*, also serve as positioning guides in attaching the cylinder head cover 4, the cam holder 42, and the cylinder head 3. Therefore, it possible to reduce the number of total knock pins needed in connecting these engine components.

It is possible to make the junction surface 67 of the cam holder 42 inclined relative to the head gasket 45 of the cylinder head 3. Even in this inclined orientation, it is not necessary for any curved or slanted boss in the secondary air supply passage 41 which extends between the head cover 4 and the cylinder head 3. In the background art, it have been necessary to provide a separate pipe member to make this connection. Therefore, by the present invention no pipe is required and the number of required parts is reduced.

Furthermore, the second passage 41*b* is bent in the cam holder 42 so that it is possible to easily form the second passage 41*b* in the cam holder 42 to correspond to the angle of the first passage 41*a* and the third passage 41*c*. Also, the bottom surface 100 of the indented section 69 formed around the lower knock pin 43 is made parallel to the junction surface 67, so that the function of the lower o-ring 44 to be contained therein, or other sealing member, will not be impaired.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An engine comprising:

a cylinder head body having a cam holder mating surface;

a cam holder attached to said cylinder head body and abutting said cam holder mating surface;

a cam shaft interposed between said cylinder head body and said cam holder;

a first passage formed in said cylinder head body;

a second passage formed in said cam holder, communicating with said first passage to pass secondary air into said cylinder head body;

a cylinder block mating surface formed on said cylinder head body; and a cylinder block attached to said cylinder head body and abutting said cylinder block mating surface, wherein said cam holder mating surface is inclined relative to said cylinder block mating surface.

2. The engine according to claim 1, further comprising:

a knock pin positioned in said second passage, said knock pin serving as a positioning guide between said cam holder and said cylinder head body.

3. The engine according to claim 2, wherein said knock pin has an axis of extension which is non-perpendicular to said cam holder mating surface.

4. The engine according to claim 1, wherein said second passage is bent so that one end of said second passage extends in a first direction aligned with said first passage and another end of said second passage extends in a second direction different from said first direction.

5. The engine according to claim 4, wherein said first direction is perpendicular to said cylinder block mating surface.

6. The engine according to claim 1, further comprising:

a first groove formed around said second passage adjacent said cam holder mating surface; and a knock pin positioned in said first groove and around said second passage, said knock pin serving as a seal between said first passage and said second passage and as a positioning guide between said cam holder and said cylinder head body.

7. The engine according to claim 6, wherein said first groove includes a first back wall against which said knock pin abuts, said first back wall being inclined relative to said cam holder mating surface and parallel relative to said cylinder block mating surface.

8. The engine according to claim 7, further comprising:

a second groove formed around said first groove; and an o-ring residing within said second groove, wherein said second groove includes a second back wall against which said o-ring abuts, said second back wall being inclined relative to said cam holder mating surface and parallel relative to said cylinder block mating surface.

9. The engine according to claim 1, wherein said cam shaft is an air intake cam shaft, and further comprising:

an exhaust camshaft interposed between said cylinder head body and said cam holder, wherein said air intake camshaft and said exhaust camshaft are parallel.

10. The engine according to claim 1, further comprising:

a cylinder head cover attached to said cam holder;

a reed valve chamber formed in said cylinder head cover;

a third passage formed in said cylinder head cover, said third passage connecting said second passage to said reed valve chamber; and an exhaust port formed in said cylinder head body, said first passage communicating with said exhaust port, such that clean air from said reed valve chamber is supplied to said exhaust port.

11. The engine according to claim 10, further comprising:

a first knock pin positioned in said second passage, said first knock pin serving as a seal between said first passage and said second passage and as a positioning guide between said cam holder and said cylinder head body; and a second knock pin positioned in said second passage, said second knock pin serving as a seal between said second passage and said third passage and as a positioning guide between said cam holder and said cylinder head cover.

12. The engine according to claim 11, wherein said second passage is bent so that one end of said second passage extends in a first direction aligned with said first passage and another end of said second passage extends in a second direction different from said first direction and aligned with said third passage.

13. The engine according to claim 12, wherein said first direction is perpendicular to said cylinder block mating surface.

14. An engine comprising:

a cylinder head body having a cam holder mating surface;

a cam holder attached to said cylinder head body and abutting said cam holder mating surface;

a cam shaft interposed between said cylinder head body and said cam holder;

a first passage formed in said cylinder head body;

a second passage formed in said cam holder, communicating with said first passage to pass secondary air into said cylinder head body; and a knock pin positioned in said second passage, said knock pin serving as a positioning guide between said cam holder and said cylinder head body, wherein said knock pin has an axis of extension which is non-perpendicular to said cam holder mating surface.

15. The engine according to claim 14, wherein said second passage is bent so that one end of said second passage extends in a first direction aligned with said first passage and another end of said second passage extends in a second direction different from said first direction.

16. An engine comprising:

a cylinder head body having a cam holder mating surface;

a cam holder attached to said cylinder head body and abutting said cam holder mating surface;

a cam shaft interposed between said cylinder head body and said cam holder;

a first passage formed in said cylinder head body;

a second passage formed in said cam holder, communicating with said first passage to pass secondary air into said cylinder head body;

a cylinder head cover attached to said cam holder;

a reed valve chamber formed in said cylinder head cover;

a third passage formed in said cylinder head cover, said third passage connecting said second passage to said reed valve chamber;

an exhaust port formed in said cylinder head body, said first passage communicating with said exhaust port, such that clean air from said reed valve chamber is supplied to said exhaust port;

a first knock pin positioned in said second passage, said first knock pin serving as a seal between said first passage and said second passage and as a positioning guide between said cam holder and said cylinder head body; and a second knock pin positioned in said second passage, said second knock pin serving as a seal between said second passage and said third passage and as a positioning guide between said cam holder and said cylinder head cover.

17. The engine according to claim 16, further comprising:

a cylinder block mating surface formed on said cylinder head body; and a cylinder block attached to said cylinder head body and abutting said cylinder block mating surface, wherein said cam holder mating surface is inclined relative to said cylinder block mating surface, and wherein said second passage is bent so that one end of said second passage extends in a first direction aligned with said first passage and another end of said second passage extends in a second direction different from said first direction and aligned with said third passage.

18. The engine according to claim 17, wherein said first direction is perpendicular to said cylinder block mating surface.

* * * * *